US005115106A

United States Patent [19]

Weiland et al.

[11] Patent Number: 5,115,106

[45] Date of Patent: May 19, 1992

[54] MOMENTARY "ON" SWITCH SUITABLE FOR KEYBOARDS

[75] Inventors: Walter M. Weiland; Michael A. Disch; Patrick L. Ohm, all of El Paso, Tex.

[73] Assignee: Honeywell Inc., Minneapolis, Minn.

[21] Appl. No.: 670,508

[22] Filed: Mar. 15, 1991

Related U.S. Application Data

[63] Continuation of Ser. No. 511,493, Apr. 20, 1990, abandoned.

[51] Int. Cl.[5] ..... H01H 1/10

[52] U.S. Cl. ..... 200/517; 200/125; 200/513

[58] Field of Search ..... 200/517, 512, 513, 5 A, 200/341, 345, 516, 517, 520, 521, 522, 530, 534, 537, 513, 342, 293

[56] References Cited

U.S. PATENT DOCUMENTS

| | | | |
|---|---|---|---|
| 3,721,778 | 3/1973 | Seeger, Jr. et al. | 200/517 |
| 4,324,472 | 4/1982 | Terada et al. | 200/517 |
| 4,489,227 | 12/1984 | Lamarche | 200/517 |
| 4,511,769 | 4/1985 | Sahakian et al. | 200/517 |
| 4,571,466 | 2/1986 | Iida | 200/5 A |
| 4,604,509 | 8/1986 | Clancy et al. | 200/513 |
| 4,876,415 | 10/1989 | Clancy | 200/5 A |

FOREIGN PATENT DOCUMENTS

| | | | |
|---|---|---|---|
| 3721319 | 12/1985 | Fed. Rep. of Germany | 200/517 |

*Primary Examiner*—Henry J. Recla
*Assistant Examiner*—David J. Walcak
*Attorney, Agent, or Firm*—Robert B. Leonard

[57] ABSTRACT

A momentary contact switch suitable for use in an electrical keyboard has cylindrical projections projecting from a baseplate with axial bores into which projections of the keys fit and by which are guided and retained. A resilient boot interposed between each key and the baseplate and surrounding the cylindrical projections bears against the underside of the key to keep its switch unclosed except when force is applied to an actuation surface of the key. A movable contact internal to the boot is transported by actuation of the key to make electrical contact with a fixed contact adjacent the cylindrical projection. In a preferred embodiment the fixed and movable contacts both have the shape of a ring and encircle the cylindrical projection. The movable contact in the preferred embodiment further is formed on a resilient surface of the boot.

17 Claims, 2 Drawing Sheets

MOMENTARY "ON" SWITCH SUITABLE FOR KEYBOARDS

This application is a continuation of application Ser. No. 07/511,493, filed Apr. 20, 1990 now abandoned.

BACKGROUND OF THE INVENTION

There are a wide variety of designs for momentary contact switches suitable for use in hand held calculators and computer keyboards. The class of designs of particular interest here are those having a plurality of individual, discrete keys projecting above their support.

Generally, the keyboards of interest here have a baseplate supporting the entire apparatus. Each key has a keytop on which there is an actuation surface for the operator to press. Each key further includes a key support projecting from the baseplate and which maintains the key in translational sliding relation with the support on an actuation path approximately normal to the baseplate with each key supported so that its actuation surface faces away from the baseplate and thus toward the operator. A movable conductive contact shifts with each key as it translates along the actuation path while being actuated. A fixed conductive contact is located in the path of, and faces the movable conductive contact and makes electrical contact with the movable electrical contact as actuation force on the key's actuation surface causes the movable conductive contact to approach the baseplate. A spring is interposed between the key and the baseplate to urge the key away from the baseplate so that electrical connection between the conductive contacts occurs only when actuation force is applied to the actuation surface.

There are a number of desirable characteristics of such a keyboard. It is preferred that it have a "click" type of feel or feedback during actuation to assure the operator that key operation is complete. In portable devices, such as calculators and laptop computers, it is preferable that the keyboard be robust to resist damage arising from hard use. The keyboard should be relatively insensitive to contamination of various types such as moisture, chemical vapors, and dust. Particularly for keyboards intended for use in portable devices such as laptop computers, it is desirable in addition that the keyboard have individual discrete key elements and that the height or thickness of the keyboard be relatively small. Ideally, such a keyboard will be no more than ½ inch (12.5 mm) thick or even less if possible. Such a keyboard should also be light so as to help keep the total weight of a laptop or portable computer low.

U.S. Pat. Nos. 4,604,509 and 4,876,415 (which has an assignee common with this application) each show a keyboard whose keys have a number of these characteristics, but the overall height of the individual keys in each is somewhat greater than is desirable in some applications. U.S. Pat. No. 4,571,466 shows another embodiment of a key suitable for use in keyboards, but again, the overall height is greater than is preferred for some applications.

BRIEF DESCRIPTION OF THE INVENTION

An improved arrangement o,f the conventional elements as described above achieves the goal of a low profile or height without sacrificing any of the other requirements. In this improved arrangement, the key support can comprise a cylindrical projection on the baseplate whose axis extends along the actuation path and which has a bore extending along the actuation path from the end of the projection toward the baseplate. The key itself in this embodiment includes a projection extending from the surface of the key opposite the actuation surface. This key projection has an external surface conforming with the cylindrical proection's bore so as to guide translation of the key along the actuation path. The key projection and the cylindrical projection cooperatively comprise a means for retaining the key projection within the bore of the cylindrical projection. In this embodiment the spring itself comprises a resilient boot in surrounding relation to the cylindrical projection. The boot has an aperture encircling the key projection. Further, there is a membrane having an aperture through which the cylindrical projection passes. This membrane carries the fixed electrical contact at a point adjacent both the cylindrical projection and the baseplate.

In the preferred commercial embodiment, both the fixed and movable conductive contacts comprise rings or segments of rings which at least partially surround the cylindrical projection. The ring comprising the movable conductive contact may internally depend from the boot and move along the actuation path with translation of the key along the actuation path. Further, the fixed conductive contact comprises on the membrane an inner and outer conductive ring which are in approximate alignment with the movable conductive contact so that when the actuation surface is pressed, the movable conductive ring contacts both the inner and outer conductive rings and connects them electrically.

In a preferred embodiment of the boot, the boot is made of molded rubber supported at a first end and at a second supporting the key and holding the movable conductive contact from electrical connection to the fixed conductive contact. The boot surrounds the cylindrical projection and a portion of the key and has an aperture through which a portion of the key passes. The boot exerts force on the key to urge the key away from the baseplate. The boot has an internal structure carrying the movable conductive contact adjacent, and preferably encircling at least partially, the cylindrical projection. Pressure on the key deforms the boot and allows the movable conductive contact to make electrical connection with the fixed conductive contact. The resiliency of the boot restores the key reliably to its unactuated position upon release of the key by the operator.

Accordingly, one object of this invention is to allow manufacture of a extremely low profile keyboard at the same time having a tactile click which signifies to the user that the switch has been actuated.

A further purpose of the invention is to provide a keyboard with such advantages and yet which is relatively light.

Yet another purpose is to allow such a keyboard to resist various types of contamination.

A last objective is to allow such a keyboard to be manufactured inexpensively and to have a relatively long, useful life.

Other objects and purpose of this invention will be apparent from the description which follows.

DESCRIPTION OF THE PREFERRED EMBODIMENTS

Figure 1:
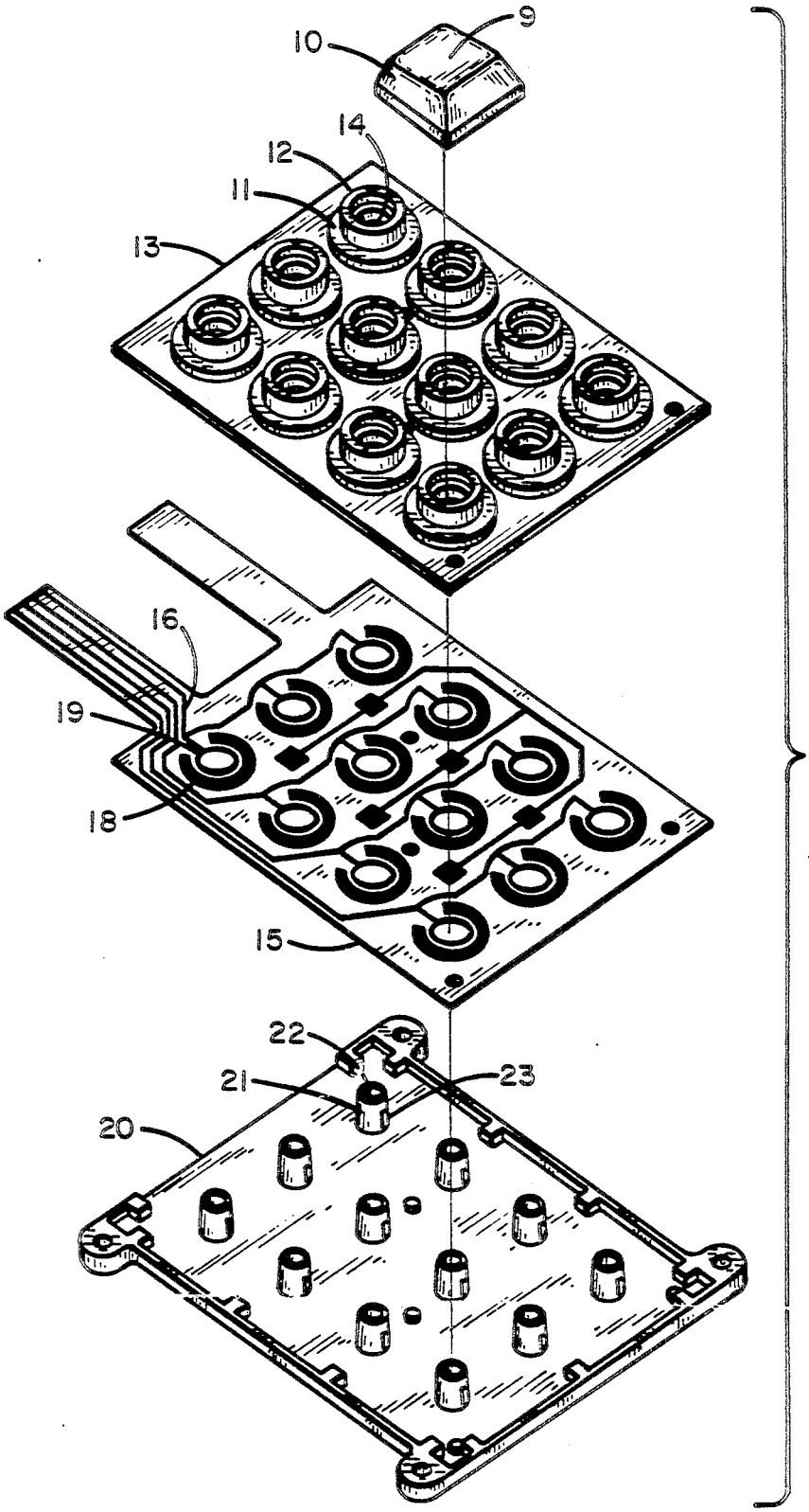
FIG. 1 is an exploded view of a keyboard employing the features of this invention.

In the exploded view of FIG. 1 there is shown a keyboard comprising a plurality of keys each of which employ the features of this invention. In understanding the operation of an individual key as shown in FIG. 1, it is helpful to refer to both FIGS. 2 and 3. Individual key 10 includes a key projection hidden in FIG. 1 but shown in cross-section in FIGS. 2 and 3 as arms 30A and 30B. On the ends of arms 30A and 30B there are tabs 32A and 32B respectively whose purpose will be made apparent below. The entire keyboard assembly is supported by a baseplate 20 which has a plurality of cylindrical projections 21. Within each cylindrical projection 21 there is a bore 22 which can conveniently pass through the entire projection 21 so that the projection 21 is essentially a hollow cylinder. As shown in FIG. 1, at the base of each projection 21 there is a slot 23. These slots are shown in the section views in FIGS. 2 and 3 as slots 23A and 23B. As can be seen most clearly in FIG. 2, the tabs 32A and 32B project outwardly from the axis of the cylindrical projection and are in mating and retaining engagement with the slots 23A and 23B in the cylindrical projection adjacent the baseplate. During assembly or if one desires to remove a key 10 from the keyboard, the arms 30A and 30B, under the influence of force on key 10 along the axis of cylindrical projection 21, deflect toward each other with the tabs 32A and 32B camming on edges of cylindrical projection 21 to cause this deflection. There is sufficient relief within each slot 23A and 23B to allow the key 10 to be translated along its actuation path toward the baseplate 20.

A molded rubber sheet 13 interposed between the key 10 and the baseplate 20 comprises a number of individual resilient boots 11 arranged and positioned in sheet 13 so as to permit sheet 13 to be carried on baseplate 20 with each individual boot 11 in surrounding relation to one cylindrical projection 21. In our preferred embodiment, a membrane 15 carrying fixed conductive ring contacts 18 and 19 is further interposed between sheet 13 and baseplate 20, although other arrangements of these elements are also within the spirit of the invention. Sheet 13 and the boots 11 carried on it are all molded from a resilient material which has high tolerance to fatigue arising from distortion and deflection. Use of the sheet 13 to support the boots 11 greatly simplifies assembly. With the tabs 32A and 32B engaged in slots 23A and 23B, the individual boots 11 are slightly deflected with their free ends 12 bearing against the underside of key 10 so that each boot 11 applies force to its associated key 10 urging key 10 away from baseplate 20. This preload provides for aging of the boot material and prevents rattling of the individual keys. Pressing on actuation surface 9 of a key 10 deflects the walls of boot 11 as shown in FIG. 3 as key 10 approaches baseplate 20. It can be seen that because the key projection comprising arms 30A and 30B conforms to the inner surface of bore 22, key 10 travels along an actuation path represented by the difference in positions of key 10 in FIG. 2 and FIG. 3. At the same time, the shape of boot 11 is such that the force provided in opposition to actuation to key 10 is nonlinear, dropping substantially as key 10 nears the maximum position which it can attain when pressed and shifted toward baseplate 20.

It should be understood that there are a number of other designs possible for the key projection beside the pair of arms 30A and 30B shown with tabs 32A and 32B to retain the key in the keyboard. For example, the key projection may be solid except for a transverse hole near its free end through which a pin may be inserted to retain the key 10 on the board. That is not a preferred design because it does not allow for removing individual keys from a keyboard without some disassembly of the keyboard, but is mentioned to illustrate the variety of designs which may be used to accomplish retaining of individual keys 10 within the keyboard.

Turning again to FIG. 1 to explain how electrical contact is made, there is a membrane 15 having a plurality of apertures 24 arranged so that membrane 15 may be laid on baseplate 20 with individual cylindrical projections passing through individual associated apertures 24. (Obviously, membrane 15 must be placed in position on baseplate 20 before either the sheet 13 carrying the boots 11 is placed in position, or before the individual keys 10 are inserted.) Membrane 15 carries adjacent each aperture 24 an inner conductive ring 19 and an outer conductive ring 18 which function as fixed conductive contacts for the associated key. Rings 18 and 19 may be applied by simple silk screening processes which apply a conductive paint in the pattern shown. Individual lead wires 16 connect one or more of the inner conductive rings.

The embodiment shown is intended for use in a so-called "capacitive-coupled keyboard," where the switch closing is communicated capacitively to the electronics of the device. The outer ring 18 is capacitively coupled to a similarly shaped ring which is located on the underside of the membrane. However, the invention is generally applicable to any type of keyboard or other type of switch where the ability to cause the switch to conduct momentarily responsive to actuation pressure is required.

Figure 2:
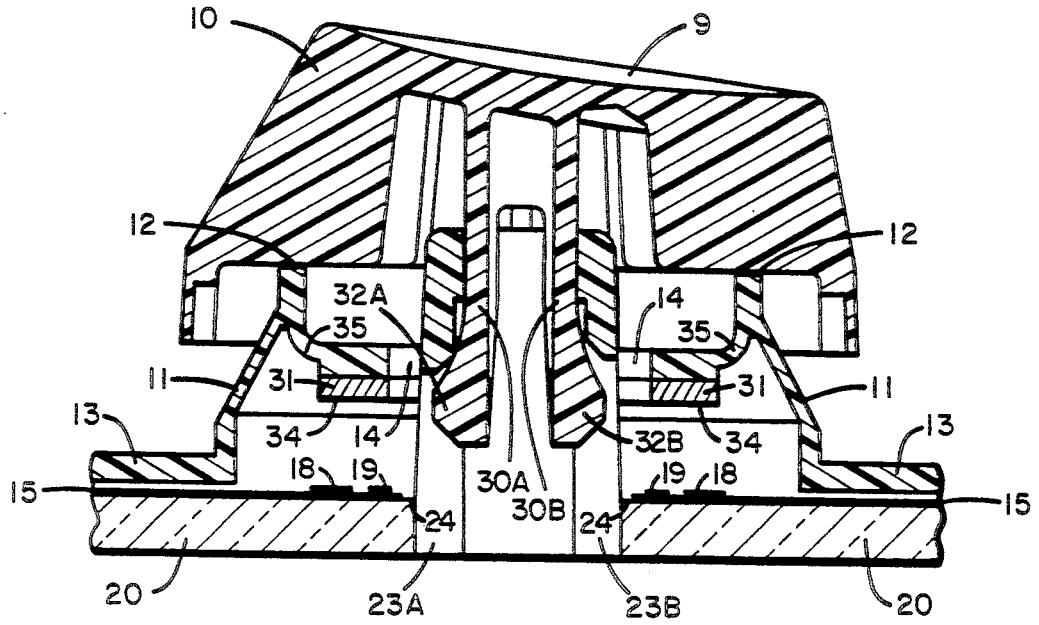
FIG. 2 is a section view of an individual key on the keyboard of key 1 of FIG. 1.
Figure 3:
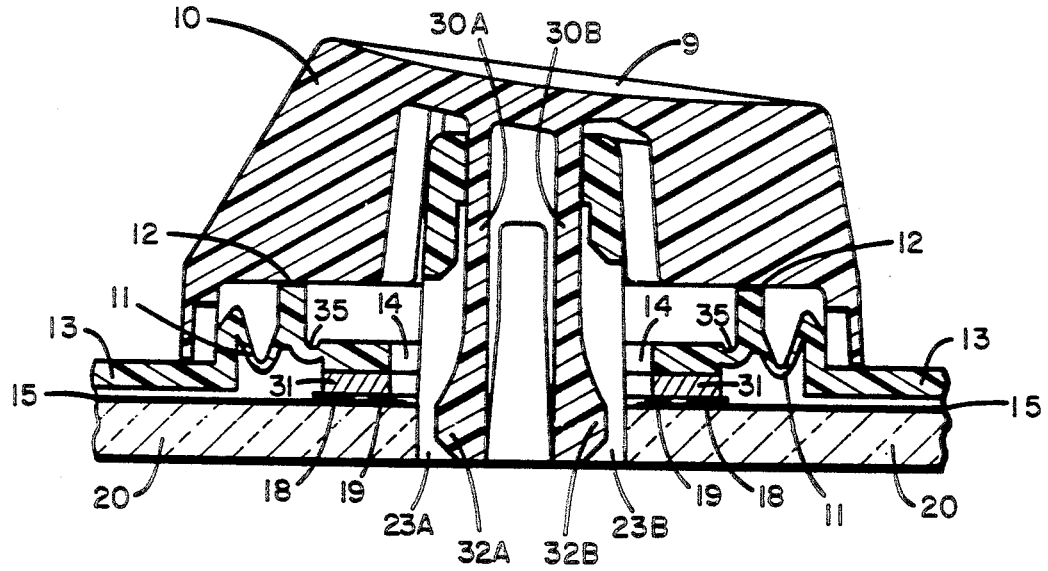
FIG. 3 is a view of the key of FIG. 2 after actuation.

To complete the connection between the inner ring 19 and the outer ring 18, there is provided in each boot 11 a ring 31 having a conductive surface 34 which comprises the moveable conductive contact, see FIGS. 2 and 3. The conductive ring 31 depends from an internal structure 35 of boot 11 and encircles and is approximately concentric with cylindrical projection 21. When key 10 is translated along its actuation path, surface 34 approaches baseplate 20 and the inner and outer conductive rings 19 and 18. As can be seen in FIG. 3, eventually surface 34 contacts both rings 18 and 19 establishing electrical connection between them. The restoring force arising from the distortion of boot 11 will return key 10 to its FIG. 2 position as soon as force is removed from the actuation surface 9.

Preferably conductive ring 31 is made from a resilient conductive material. One material which we presently favor is a compound whose identifying number is CA1-7511C and which is available from the Kokoku Rubber Industrial Company, Ltd. of Tokyo, Japan. It is also possible to simply coat a non-conductive rubber with a flexible conductive paint at surface 34 to provide the electrical contact and conduction between rings 18 and 19 on membrane 15. Resiliency of ring 31 assures adequate electrical connection between surface 34 and both rings 18 and 19 regardless of any misalignment or misregistration between key 10 and projection 21.

Having thus described our invention, what we claim by Letters Patent is:

1. In a keyboard having a baseplate; a key having a keytop on which is an actuation surface; a key support projecting from said baseplate and maintaining said key in translational sliding relation with said support along an actuation path approximately normal to the baseplate with the actuation surface facing away from the baseplate; a movable conductive contact shifting with the key's translation along the actuation path; a fixed conductive contact in the path of and facing the movable conductive contact and making electrical contact with the movable electrical contact when force on the keytop causes the movable conductive contact to approach the baseplate; and a spring contacting both the key and the baseplate to urge the key away from the baseplate, an improved arrangement of the keyboard's elements wherein the support comprises a cylindrical projection having an end spaced from the baseplate, an axis extending along the actuation path, and a bore extending along the actuation path from the end of the projection toward the baseplate; wherein the key includes a projection extending from a surface of the key opposite the actuation surface, said key projection's external surface conforming with the cylindrical projection's bore so as to guide translation of the key along the actuation path; wherein the key projection and cylindrical projection cooperatively comprises a means for retaining the key projection within the bore of the cylindrical projection; and wherein the spring comprises a resilient boot in surrounding relation to the cylindrical projection, said boot having an aperture through which the key projection passes; said improved arrangement further including a membrane having an aperture through which the cylindrical projection passes, said membrane carrying the fixed electrical contact at a point adjacent both the cylindrical projection and the baseplate.

2. The improved keyboard arrangement of claim 1, wherein the movable conductive contact comprises a conductive resilient ring carried on the boot, said ring approximately concentric with the axis of the cylindrical projection.

3. The keyboard of claim 1, wherein the baseplate has a top surface which defines a plane and the cylindrical projection's bore extends through the plane of the top surface of the baseplate.

4. The keyboard of claim 1, wherein the cylindrical projection's bore extends completely through the baseplate.

5. The improved keyboard arrangement of claim 1, wherein the fixed conductive contact comprises a conductive ring approximately concentric with the axis of the cylindrical projection.

6. The improved keyboard arrangement of claim 5, wherein the movable conductive contact comprises a conductive resilient ring carried on the boot, said ring approximately concentric with the axis of the cylindrical projection.

7. The improved keyboard arrangement of claim 1, wherein the movable conductive contact comprises a conductive ring in surrounding relation to the cylindrical projection within and attached to the boot and moving along the actuation path with translation of the key.

8. The improved keyboard arrangement of claim 7, wherein the fixed conductive contact comprises on the membrane an inner and an outer conductive ring each approximately concentric with the cylindrical projection and made of conductive material, and wherein the internal and external edges of the conductive ring comprising the movable conductive contact are in approximate alignment with the inner and outer conductive rings respectively.

9. The improved keyboard arrangement of claim 1, wherein the key projection further comprises on the end thereof, at least one tab projecting outwardly from the axis of the cylindrical projection and in mating and retaining engagement with a slot in the cylindrical projection adjacent the baseplate.

10. The improved keyboard arrangement of claim 9, wherein the key projection comprises a pair of approximately parallel arms each carrying a tab at its end, each tab projecting away from the other, and the cylindrical projection has a pair of opposed slots in each of which is engaged the tab of one arm.

11. In a keyboard having a baseplate; a key having an actuation surface; a key support comprising a cylindrical projection projecting from said baseplate and supporting said key for translational sliding relative to said support along an actuation path approximately normal to the baseplate; a movable conductive contact shifting with the key's translation along the actuation path; a fixed conductive contact in the path of and facing the movable conductive contact and making electrical contact with the movable electrical contact when force on the key causes the movable conductive contact to approach the baseplate; and a spring supporting the key and supported by the baseplate and urging the key away from the baseplate, an improved arrangement for the movable conductive contact and the spring, comprising a resilient boot supported at a first end by the baseplate and at a second end supporting the key, said boot surrounding said cylindrical projection and a portion of said key and having an aperture through which a portion of the key passes, said boot exerting force on the key urging the key away from the baseplate, and said boot further having an internal structure carrying the movable conductive contact adjacent the cylindrical projection.

12. The improved keyboard movable conductive contact and spring arrangement of claim 11 wherein the movable conductive contact comprises a resilient material having a conductive surface facing the fixed conductive contact.

13. The improved keyboard movable conductive contact and spring arrangement of claim 11 wherein the movable conductive contact comprises at least a segment of a conductive ring depending from the interior surface of the boot and at least partially encircling the portion of the key which passes through the boot's aperture and the cylindrical projection.

14. The improved keyboard movable conductive contact and spring arrangement of claim 13 wherein the conductive ring comprises a resilient material having a conductive surface facing the fixed conductive contact.

15. A keyboard, comprising:

a base plate having at least one projection thereon, each said projection having a bore therethrough;

a membrane having a number of holes, said holes being located so as to be concentric with said projections, said membrane further having at least one fixed contact; and switch actuation means, comprising:

at least one key, said key having first and second surfaces, said second surface having a projection which rides in said bore, said key being moveable axially along said bore;

key return means having a first side next to said membrane supported by said membrane and said base plate, and formed with a hole therethrough, said projection of said base plate and said projection of said key passing through said key return means; and a movable contact mounted on said key return means adapted to contact one of said fixed contacts to complete an electrical path upon depression of said key.

16. The keyboard of claim 15, wherein:

said fixed contact consists of first and second substantially circular rings formed to be concentric with said holes.

17. The keyboard of claim 15, wherein:

said movable contact is comprised of a ring of conductive material formed on said first side of said key return means.

* * * * *